US007523948B1

(12) United States Patent
Wright

(10) Patent No.: US 7,523,948 B1
(45) Date of Patent: Apr. 28, 2009

(54) IN-LINE SKATE

(75) Inventor: Stanton Wright, 69 Roselawn Avenue, Toronto, ON (CA) M4R 1E7

(73) Assignee: Stanton Wright, Toronto (CA)

( * ) Notice: Subject to any disclaimer, the term of this patent is extended or adjusted under 35 U.S.C. 154(b) by 0 days.

(21) Appl. No.: 11/968,767

(22) Filed: Jan. 3, 2008

(51) Int. Cl.
*A63C 17/06* (2006.01)

(52) U.S. Cl. ..... 280/11.222; 280/11.215; 280/11.221; 280/11.223; 280/11.28; 280/11.19

(58) Field of Classification Search ..... 280/11.215, 280/11.221, 11.223, 11.28, 11.19
See application file for complete search history.

(56) References Cited

U.S. PATENT DOCUMENTS 2,245,769 A * 6/1941 Flamm ..... 280/11.19
4,272,091 A * 6/1981 Reid, Jr. ..... 280/11.28
5,183,276 A * 2/1993 Pratt ..... 280/11.221
5,566,958 A * 10/1996 Sinelnikov et al. ..... 280/11.231
5,620,190 A * 4/1997 Maggiore ..... 280/11.201
5,855,385 A * 1/1999 Hambsch ..... 280/87.042
5,908,196 A * 6/1999 Weiss ..... 280/11.19
6,042,123 A * 3/2000 Eck, Sr. ..... 280/11.19
6,070,885 A * 6/2000 Ferone ..... 280/11.19
6,422,578 B1 * 7/2002 Oh ..... 280/11.232
6,467,777 B2 * 10/2002 Teyhen ..... 280/11.115
7,175,187 B2 * 2/2007 Lyden ..... 280/11.3

* cited by examiner

*Primary Examiner*—Christopher P Ellis
*Assistant Examiner*—Cynthia F Collado
(74) *Attorney, Agent, or Firm*—Dimock Stratton LLP

(57) ABSTRACT

An in-line skate which includes a plurality of wheels mounted to a frame each having a primary contact surface which contacts a skating surface to support the skater when the skate is in a generally upright position, and at least one secondary rotatable contact surface disposed at a level above the primary contact surfaces when the skate is in a generally upright position and positioned to contact the skating surface only when the in-line skate is inclined beyond a selected angle from the vertical. The length of the wheelbase formed by the secondary contact surface is shorter than the length of the wheelbase formed by the primary contact surfaces. By effectively changing the length of the wheelbase of the in-line skate when the in-line skate is at a certain angle from the vertical, a tighter turning radius may be achieved.

48 Claims, 4 Drawing Sheets

IN-LINE SKATE

FIELD OF THE INVENTION

The present invention relates to in-line skates.

BACKGROUND OF THE INVENTION

Roller skates have been used for many decades. Originally roller skates consisted of a boot attached to front and back pairs of wheels. Such roller skates were popular as a leisure activity, but because of the wheel arrangement and attendant limitations on the speed and stability of the skater, they were not suitable as a mode of transportation.

More recently in-line skates have become popular. In-line skates typically have four or five wheels mounted in a common plane in spaced-apart alignment. This allows for greater speed.

The turning radius of the in-line skate is dependent upon a number of factors, one of which is the length as measured from the axle of the front wheel to the axle of the back wheel, known as the wheelbase. A longer wheelbase is advantageous for stability and speed when skating straight, and often the wheel frame is designed so that front wheel extends beyond the toe of the boot and/or the rear wheel extends beyond the heel of the boot, which increases the length of the supporting wheel assembly and thus improves stability. But because the wheel base is fixed and the wheels are in line, basic geometry dictates a certain minimum turning radius for a wheelbase of any specific length. In order to effect a tight turn, a skilled skater will slow down and lift one leg over the other (known as a "crossover"), during which the skater's stability is reduced; even doing so, the wheelbase of the supporting skate still limits the radius of the turn.

It would accordingly be advantageous to provide an in-line skate that has a long wheelbase for stability during straight runs, but is capable of achieving a turning radius that is shorter than that dictated by the geometry of the long wheelbase.

BRIEF DESCRIPTION OF THE DRAWINGS

In drawings which illustrate by way of example only preferred embodiments of the invention.

DETAILED DESCRIPTION OF THE INVENTION

The present invention provides an in-line skate that has a long wheelbase as required for stability and speed during straight runs, but is capable of achieving a turning radius that is shorter than that dictated by the geometry of the long wheelbase. According to the invention the skater is supported by primary contact surfaces formed on each of a plurality of primary wheels when the skater is in a substantially vertical position, but the skater is supported only by secondary contact surfaces during a turn, when the in line skate is inclined beyond a selected angle from the vertical. This gives an in-line skater the ability to make very short and quick turns and/or stops.

The present invention thus provides an in-line skate comprising: a boot; a frame secured to the boot; a plurality of primary wheels substantially in alignment and rotatably mounted to the frame, whereby at least a portion of a primary contact surface of each of the primary wheels is exposed below the frame for contacting a skating surface along a primary wheelbase when the skate is in a generally upright position; and at least one secondary rotatable contact surface disposed at a level above the primary contact surfaces when the skate is in a generally upright position and positioned to contact the skating surface along a secondary wheelbase only when the in-line skate is inclined beyond a selected angle from the vertical, whereby the primary contact surfaces support a skater when the in-line skate is in a substantially vertical position, and the at least one secondary contact surface contacts the skating surface and supports the skater when the in-line skate is inclined beyond the selected angle from the vertical, the secondary wheelbase being shorter than the primary wheelbase.

The present invention further provides a wheel set for an in-line skate comprising: a frame for securing to a boot; a plurality of primary wheels substantially in alignment and rotatably mounted to the frame, whereby at least a portion of a primary contact surface of each of the primary wheels is exposed below the frame for contacting a skating surface along a primary wheelbase when the skate is in a generally upright position; and at least one secondary rotatable contact surface disposed at a level above the primary contact surfaces when the skate is in a generally upright position and positioned to contact the skating surface along a secondary wheelbase only when the in-line skate is inclined beyond a selected angle from the vertical, whereby when the frame is affixed to a boot worn by a skater, the primary contact surfaces support a skater when the in-line skate is in a substantially vertical position, and the at least one secondary contact surface contacts the skating surface and supports the skater when the in-line skate is inclined beyond the selected angle from the vertical, the secondary wheelbase being shorter than the primary wheelbase.

Figure 1:
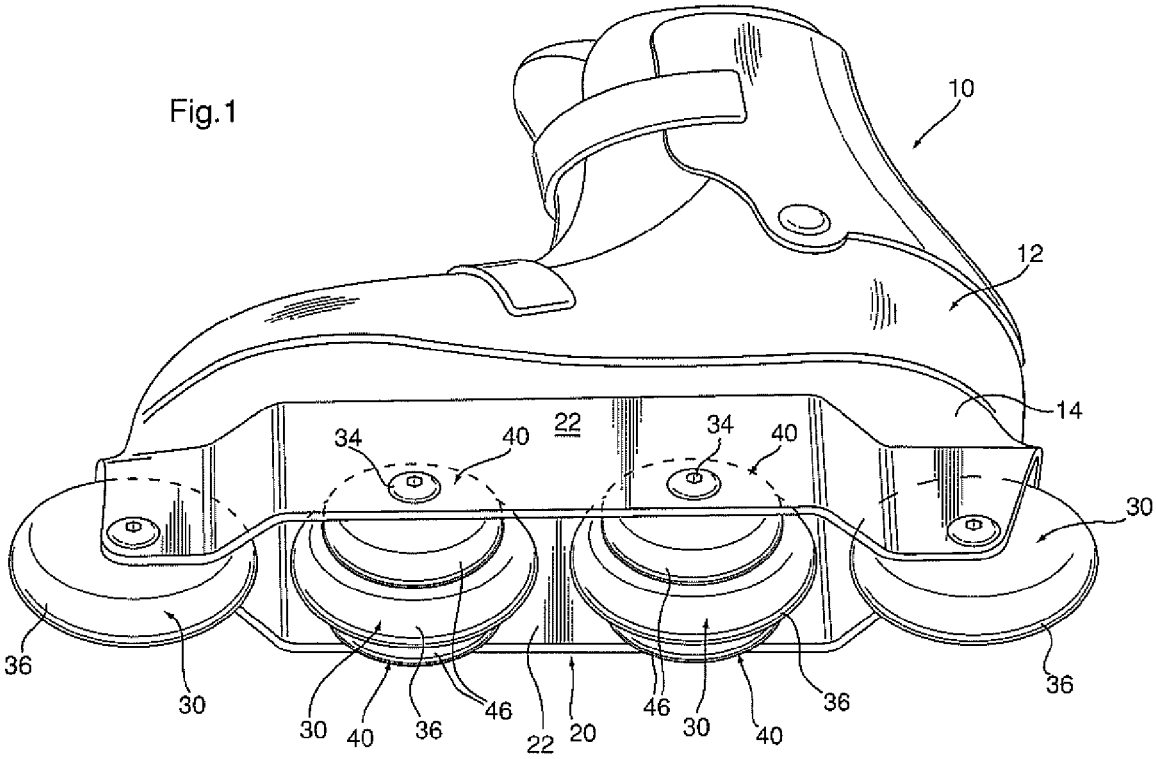
FIG. 1 is a bottom perspective view of an embodiment of an in-line skate according to the invention.
Figure 2:
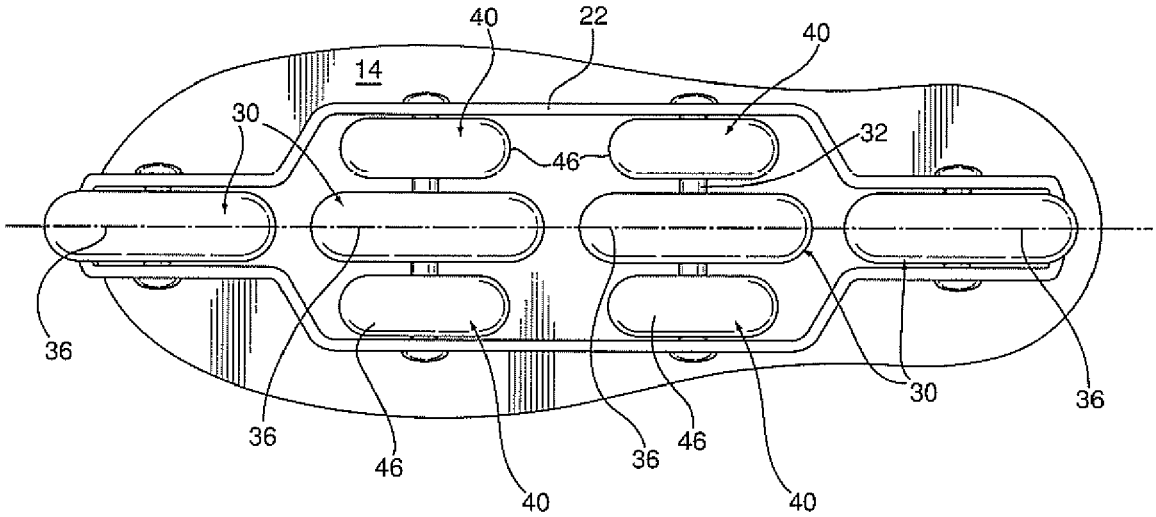
FIG. 2 is a bottom plan view of an the in-line skate of FIG. 1.

An embodiment of the present invention is illustrated in FIGS. 1 and 2. An in-line skate 10 according to the invention includes a boot 12. The boot 12 may be a conventional boot, for example having a shell molded from plastic and padded for the comfort of the user and to ensure a proper fit. The boot 12 may alternatively comprise any suitable footwear or other means of attaching the wheel frame 20 to the foot of a user.

The boot 12 is secured to the frame 20. The boot 12 may be detachably secured to the frame 20 using any suitable detachable securing means, or may be permanently affixed. In the embodiment shown the frame 20 comprises a pair of side walls 22 formed integrally with the sole 14 of the boot 12, for example by injection molding. The sidewalls are configured to support primary and secondary wheels 30, 40, as described below.

A plurality of primary wheels 30 are rotatably mounted to the frame 20. In the embodiment shown in FIGS. 1 and 2, each of the primary wheels 30 is mounted to the frame 12 by being rotatably disposed over an axle 32, which is in turn secured to the frame 12 by, for example, nuts 34 engaged over threaded ends (not shown) of the axles 32. Each of the primary wheels 30 is preferably engaged over the axle 32 such that it can substantially freely rotate around the axle 32, for example via ball bearings (not shown) as is conventional. The plurality of primary wheels 30 are mounted in the frame 12 substantially in alignment, such that at least a portion of a primary contact surface 36 of each of the primary wheels 30 is exposed below the frame 12, for contacting a skating surface 2 when the skate is in a generally upright position along a primary wheelbase length 38 (shown in FIG. 3A) defined by the distance between the point of contact of the front-most primary wheel 30 with the skating surface 2 and the point of contact of the rear-most primary wheel 30 with the skating surface 2.

Figure 3A:
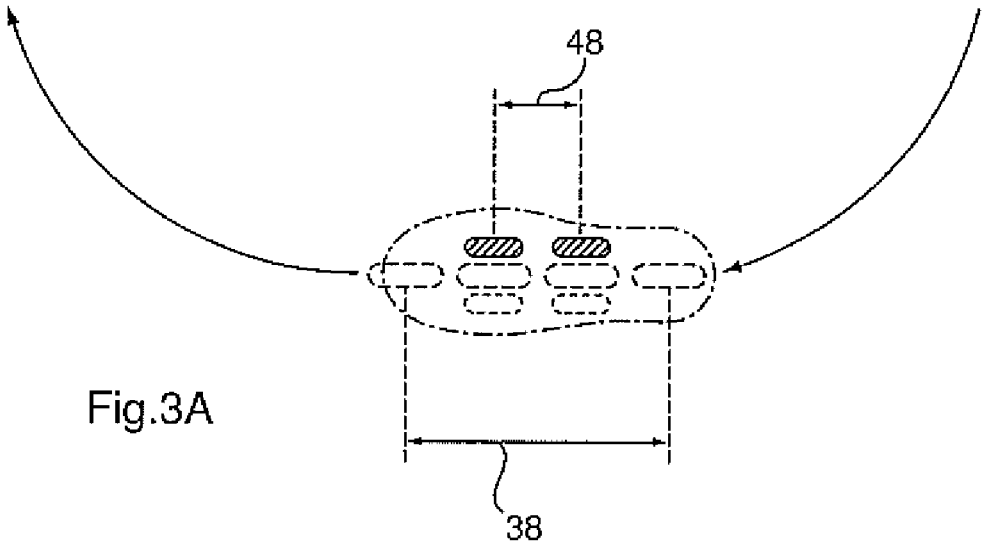
FIG. 3A is a schematic bottom view showing the contact surface that is engaged when the in-line skate of FIG. 1 is inclined beyond a selected angle from the vertical during a turn.
Figure 4A:
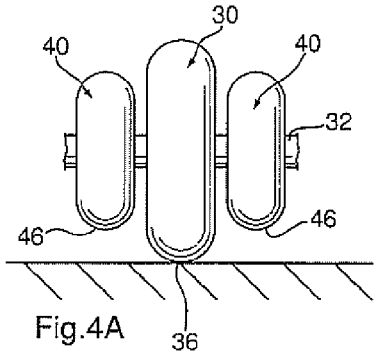
FIG. 4A is a front elevation of a wheel assembly according to the invention in a substantially upright position.
Figure 4B:
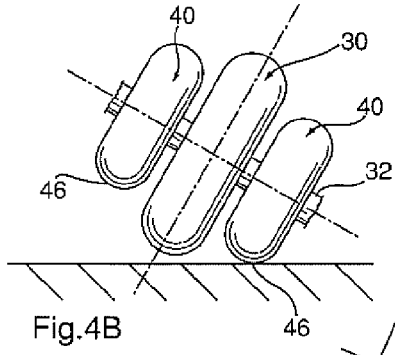
FIG. 4B is a front elevation of the wheel assembly of FIG. 4A inclined beyond a selected angle from the vertical.

According to the invention, at least one secondary rotatable contact surface 46 is disposed at a level above the primary contact surfaces 36 when the skate 10 is in a generally upright position, for example as shown in FIG. 4A. In the embodiment illustrated in FIGS. 1 and 2, the secondary contact surface 46 is the outer circumference of a secondary wheel 40. The secondary contact surface 46 is positioned to contact the skating surface only when the in-line skate is inclined beyond a selected angle from the vertical, for example as shown in FIG. 4B. The selected angle is defined by the point at which the secondary contact surface 46 contacts the skating surface 2, and beyond this angle the primary contact surface 36 is raised from the skating surface 2, as shown in FIG. 4B. Thus, when the skate is disposed at an angle beyond the selected angle from the vertical, which is typical and natural when the skater is turning, the secondary contact surface 46 becomes the exclusive contact with the skating surface 2 and the skater is supported on the shorter wheelbase length 48 illustrated in FIG. 3A. In this way, a shorter turning radius may be achieved.

In the embodiment illustrated in FIGS. 1 and 2, there are two sets of secondary contact surfaces 46, respectively disposed on two sets of secondary wheels 40. The secondary wheels 40 are mounted on a common axle 32 with each of the two primary wheels 30 that are disposed in the intermediate portion of the frame 12, i.e. the second and third primary wheels 30, on either side of these two primary wheels 30. The secondary wheels 40 may be permitted to rotate freely independently of their respective associated primary wheel 30, or may be rotationally fixed to the primary wheel 30.

Because they are mounted on the same axle 32 as their associated primary wheel 30, in this embodiment the diameters of the secondary wheels 40 must be less than the diameters of the primary wheels 30 so that the secondary contact surfaces 46 are disposed at a level above the primary contact surfaces 36 when the skate 10 is in a generally upright position. This could alternatively be accomplished using secondary wheels 40 that are the same size as (or larger than) the primary wheels 30, but in such a case the secondary wheels 40 should have to be mounted on independent axles (not shown) in order for the secondary contact surfaces 46 to be disposed at a level above the primary contact surfaces 36 when the skate 10 is in a generally upright position.

Preferably secondary contact surfaces 46 are provided on each side of the primary contact surface 36 of the intermediate wheels 30, so that the secondary contact surfaces 46 will contact the skating surface 2 only when the in-line skate is inclined beyond a selected angle from either side of the vertical, allowing the skater to benefit from the smaller turning radius permitted by the invention regardless which direction he or she is turning.

Figure 6:
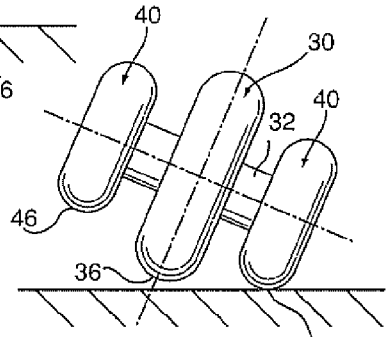
FIG. 6 is a front elevation of a still further embodiment of a wheel assembly according to the invention.

The selected angle from the vertical is determined by the extent to which the secondary contact surfaces 46 are disposed above the primary contact surfaces 36, and the distance of the secondary contact surfaces 46 from the primary contact surfaces 36. For example, the selected angle in the embodiment of FIG. 6 is less than that in the embodiment of FIGS. 4A and 4B because although the size of the secondary wheels 40 is the same in each embodiment, the distance of the secondary wheels 40 (and therefore the secondary contact surfaces 46) from the primary contact surface 36 is greater in the embodiment of FIG. 6 and the secondary contact surfaces 46 on FIG. 6 will contact the skating surface 2 at a smaller angle from the vertical than in the embodiment of FIGS. 4A and 4B. It is of course possible to make the diameters of the secondary contact surfaces 46 on each side of the primary wheel 30, and/or their distance from the primary wheel 30, different, which will result in the selected angle being different when turning in one direction than when turning in the other, or different as between the left and right skates (there being no necessary limit on the number of primary wheels or secondary contact surfaces).

The wheel assemblies illustrated are a convenient means of achieving the invention, however it will be appreciated that there are other ways of forming the secondary contact surfaces 46. For example, in the embodiment of the invention illustrated in FIGS. 5A and 5B, the secondary contact surfaces 46 are formed on roller-like projections 50 from the primary wheel 30, the roller-like projections 50 constituting secondary wheels.

Figure 3B:
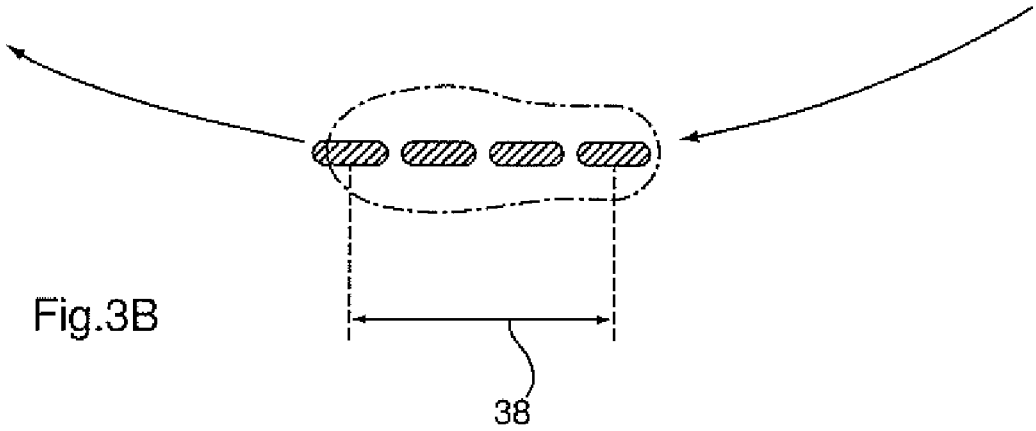
FIG. 3B is a schematic bottom view showing the contact surface that is engaged in a conventional in-line skate during a turn.

FIGS. 3A and 3B illustrates the difference in turning radius between an in-line skate 10 of the present invention and a conventional in-line skate. In the conventional skate of FIG. 3B, each of the wheels are in contact with the skating surface 2 while the skater is turning. The turning radius is dictated by the long length 36 of the resulting wheelbase. In the embodiment of the invention illustrated in FIG. 3A, only the secondary contact surfaces 46 are in contact with the skating surface 2 while the skater is turning, and a shorter turning radius is achieved as a result of the shorter length 48 of the wheelbase that is engaged with the skating surface 2.

In operation, the skater skating in generally a straight line is supported by the primary contact surfaces 36 disposed about the primary wheels 30. The length 38 of the wheelbase is as shown in FIG. 3A. The manner in which the skater comes to be supported on the secondary contact surfaces 46 is shown in FIGS. 4A and 4B in relation to the embodiment illustrated in FIG. 1. FIG. 4A shows the primary contact surfaces 36 of the primary wheels 30 in contact with the skating surface 2. As the skater leans into a turn, the angle of inclination of the skate 10 (and thus the primary wheels 30) from the vertical increases until, at the selected angle, the secondary contact surfaces 46 contact the skating surface 2. Beyond the selected angle, as shown in FIG. 4B, only the secondary contact surfaces 46 are in contact with the skating surface 2. Because the length 48 of the wheelbase on the secondary contact surfaces 46 is shorter than the length 38 of the wheelbase on the primary contact surfaces 36, as shown in FIG. 3A, the skater can achieve a smaller turning radius for turning and stopping than is available in the conventional in-line skate shown in FIG. 3B, the wheelbase for which is invariable and solely determined by the distance between it's front-most and rear-most wheels.

Figure 5A:
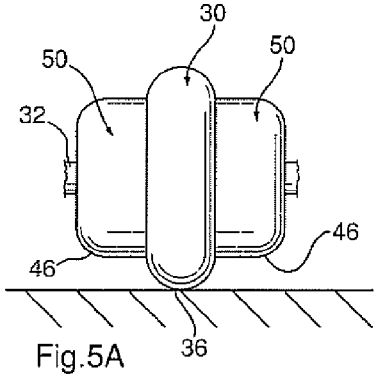
FIG. 5A is a front elevation of a further embodiment of a wheel assembly according to the invention in a substantially upright position.
Figure 5B:
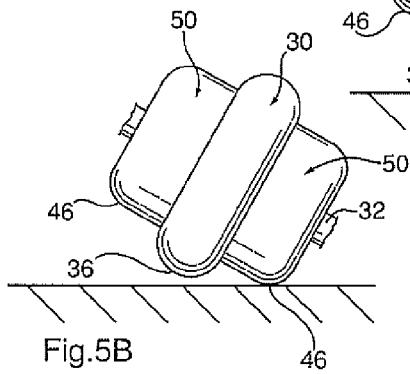
FIG. 5B is a front elevation of the embodiment of FIG. 5A inclined beyond a selected angle from the vertical.

FIGS. 5A and 5B illustrate this effect in relation to another embodiment of the invention, in which the secondary contact surfaces 46 are disposed about wheel-like projections extending axially from and concentric with the faces of the primary wheels 30. FIG. 5A shows the primary wheel 30 in a substantially vertical position, whereby the primary contact surface 36 is in contact with the skating surface 2 and the secondary contact surface 46 is raised from the skating surface. FIG. 5B shows the primary wheel 30 inclined beyond the selected angle from the vertical, whereby one of secondary contact surfaces 46 is in contact with the skating surface 2.

FIG. 6 illustrates this effect in relation to another embodiment of the invention, in which the selected angle of inclination from the vertical has been reduced from the embodiment of FIG. 4A by lengthening the distance between the primary contact surface 36 and the secondary contact surface 46, the diameter of the secondary wheels 40 being the same in both embodiments.

Various embodiments of the present invention having been thus described in detail by way of example, it will be apparent to those skilled in the art that variations and modifications may be made without departing from the invention.

What is claimed is:

1. An in-line skate comprising:

a boot;

a frame secured to the boot;

a plurality of primary wheels substantially in alignment and rotatably mounted to the frame, whereby at least a portion of a primary contact surface of each of the primary wheels is exposed below the frame for contacting a skating surface along a primary wheelbase when the skate is in a generally upright position, said primary wheels each rotating about a respective primary axle, said primary axle extending through said frame and at least one secondary rotatable contact surface disposed at a level above the primary contact surfaces when the skate is in a generally upright position and positioned to contact the skating surface along a secondary wheelbase only when the in-line skate is inclined beyond a selected angle from the vertical, the at least one secondary rotatable contact surface rotating about a respective secondary axle that is substantially parallel to the primary axle, the secondary axle being mounted to the frame such that the secondary axle extends throughout the width of the frame, whereby the primary contact surfaces support a skater when the in-line skate is in a substantially vertical position, and the at least one secondary contact surface contacts the skating surface and supports the skater when the in-line skate is inclined beyond the selected angle from the vertical, the secondary wheelbase being shorter than the primary wheelbase.

2. The in-line skate of claim 1, wherein the at least one secondary contact surface is formed on at least one secondary wheel.

3. The in-line skate of claim 2, wherein the at least one secondary wheel is mounted on the same axis as at least one of the plurality of primary wheels.

4. The in-line skate of claim 2, wherein the secondary wheel is mounted on an independent axis.

5. The in-line skate of claim 1, wherein the at least one secondary contact surface is disposed on a roller-like projection extending axially from at least one of the primary wheels.

6. The in-line skate of claim 1 wherein a secondary contact surface is disposed on either side of at least one of the primary wheels.

7. The in-line skate of claim 6 comprising at least four primary wheels in substantial alignment, wherein a secondary contact surface is disposed on each side of two of the primary wheels other than a front-most primary wheel and a rear-most primary wheel.

8. The in-line skate of claim 7, wherein the secondary contact surfaces are formed on secondary wheels.

9. The in-line skate of claim 7, wherein the secondary contact surfaces are formed on roller-like projection extending axially from the primary wheels.

10. The in-line skate of claim 6 comprising at least four primary wheels in substantial alignment, wherein a secondary contact surface is disposed on each side of two adjacent primary wheels.

11. A wheel set for an in-line skate comprising:

a frame for securing to a boot;

a plurality of primary wheels substantially in alignment and rotatably mounted to the frame, whereby at least a portion of a primary contact surface of each of the primary wheels is exposed below the frame for contacting a skating surface along a primary wheelbase when the skate is in a generally upright position, said primary wheels each rotating about a respective primary axle, said primary axle extending through said frame and at least one secondary rotatable contact surface disposed at a level above the primary contact surfaces when the skate is in a generally upright position and positioned to contact the skating surface along a secondary wheelbase only when the in-line skate is inclined beyond a selected angle from the vertical, the at least one secondary rotatable contact surface rotating about a respective secondary axle that is substantially parallel to the primary axle, the secondary axle being mounted to the frame such that the secondary axle extends throughout the width of the frame, whereby when the frame is affixed to a boot worn by a skater, the primary contact surfaces support a skater when the in-line skate is in a substantially vertical position, and the at least one secondary contact surface contacts the skating surface and supports the skater when the in-line skate is inclined beyond the selected angle from the vertical, the secondary wheelbase being shorter than the primary wheelbase.

12. The wheel set of claim 11, wherein the at least one secondary contact surface is formed on at least one secondary wheel.

13. The wheel set of claim 12, wherein the at least one secondary wheel is mounted on the same axis as at least one of the plurality of primary wheels.

14. The wheel set of claim 12, wherein the secondary wheel is mounted on an independent axis.

15. The wheel set of claim 11, wherein the at least one secondary contact surface is disposed on a roller-like projection extending axially from at least one of the primary wheels.

16. The wheel set of claim 11 wherein a secondary contact surface is disposed on either side of at least one of the primary wheels.

17. The wheel set of claim 16 comprising at least four primary wheels in substantial alignment, wherein a secondary contact surface is disposed on each side of two of the primary wheels other than a front-most primary wheel and a rear-most primary wheel.

18. The wheel set of claim 17, wherein the secondary contact surfaces are formed on secondary wheels.

19. The in-line skate of claim 17, wherein the secondary contact surfaces are formed on roller-like projection extending axially from the primary wheels.

20. The wheel set of claim 16 comprising at least four primary wheels in substantial alignment, wherein a secondary contact surface is disposed on each side of two adjacent primary wheels.

21. An in-line skate of claim 1, wherein the primary axle and the secondary axle are the same.

22. A wheel set for an in-line skate of claim 11, wherein the primary axle and the secondary axle are the same.

23. An in-line skate of claim 1, wherein the primary axle and the secondary axle are independent.

24. A wheel set for an in-line skate of claim 11, wherein the primary axle and the secondary axle are independent.

25. An in-line skate comprising:

a boot;

a frame secured to the boot;

a plurality of primary wheels substantially in alignment and rotatably mounted to the frame, whereby at least a portion of a primary contact surface of each of the primary wheels is exposed below the frame for contacting a skating surface along a primary wheelbase when the skate is in a generally upright position, said primary wheels each rotating about a respective primary axle, said primary axle extending through said frame and at least one secondary rotatable contact surface disposed at a level above the primary contact surfaces when the skate is in a generally upright position and positioned to contact the skating surface along a secondary wheelbase only when the in-line skate is inclined beyond a selected angle from the vertical, the at least one secondary rotatable contact surface rotating about a respective secondary axle that is substantially parallel to the primary axle, whereby the plurality of primary wheels and the at least one secondary rotatable contact surface are disposed substantially within the footprint of the boot when the skate is in a generally upright position, whereby the primary contact surfaces support a skater when the in-line skate is in a substantially vertical position, and the at least one secondary contact surface contacts the skating surface and supports the skater when the in-line skate is inclined beyond the selected angle from the vertical, the secondary wheelbase being shorter than the primary wheelbase.

26. The in-line skate of claim 25, wherein the at least one secondary contact surface is formed on at least one secondary wheel.

27. The in-line skate of claim 26, wherein the at least one secondary wheel is mounted on the same axis as at least one of the plurality of primary wheels.

28. The in-line skate of claim 26, wherein the secondary wheel is mounted on an independent axis.

29. The in-line skate of claim 25, wherein the at least one secondary contact surface is disposed on a roller-like projection extending axially from at least one of the primary wheels.

30. The in-line skate of claim 25 wherein a secondary contact surface is disposed on either side of at least one of the primary wheels.

31. The in-line skate of claim 30 comprising at least four primary wheels in substantial alignment, wherein a secondary contact surface is disposed on each side of two of the primary wheels other than a front-most primary wheel and a rear-most primary wheel.

32. The in-line skate of claim 31, wherein the secondary contact surfaces are formed on secondary wheels.

33. The in-line skate of claim 31, wherein the secondary contact surfaces are formed on roller-like projection extending axially from the primary wheels.

34. The in-line skate of claim 30 comprising at least four primary wheels in substantial alignment, wherein a secondary contact surface is disposed on each side of two adjacent primary wheels.

35. A wheel set for an in-line skate comprising:

a frame for securing to a boot;

a plurality of primary wheels substantially in alignment and rotatably mounted to the frame, whereby at least a portion of a primary contact surface of each of the primary wheels is exposed below the frame for contacting a skating surface along a primary wheelbase when the skate is in a generally upright position, said primary wheels each rotating about a respective primary axle, said primary axle extending through said frame and at least one secondary rotatable contact surface disposed at a level above the primary contact surfaces when the skate is in a generally upright position and positioned to contact the skating surface along a secondary wheelbase only when the in-line skate is inclined beyond a selected angle from the vertical, the at least one secondary rotatable contact surface rotating about a respective secondary axle that is substantially parallel to the primary axle, whereby the plurality of primary wheels and the at least one secondary rotatable contact surface are disposed substantially within the footprint of the boot when the skate is in a generally upright position, whereby when the frame is affixed to a boot worn by a skater, the primary contact surfaces support a skater when the in-line skate is in a substantially vertical position, and the at least one secondary contact surface contacts the skating surface and supports the skater when the in-line skate is inclined beyond the selected angle from the vertical, the secondary wheelbase being shorter than the primary wheelbase.

36. The wheel set of claim 35, wherein the at least one secondary contact surface is formed on at least one secondary wheel.

37. The wheel set of claim 36, wherein the at least one secondary wheel is mounted on the same axis as at least one of the plurality of primary wheels.

38. The wheel set of claim 36, wherein the secondary wheel is mounted on an independent axis.

39. The wheel set of claim 35, wherein the at least one secondary contact surface is disposed on a roller-like projection extending axially from at least one of the primary wheels.

40. The wheel set of claim 35 wherein a secondary contact surface is disposed on either side of at least one of the primary wheels.

41. The wheel set of claim 40 comprising at least four primary wheels in substantial alignment, wherein a secondary contact surface is disposed on each side of two of the primary wheels other than a front-most primary wheel and a rear-most primary wheel.

42. The wheel set of claim 41, wherein the secondary contact surfaces are formed on secondary wheels.

43. The in-line skate of claim 41, wherein the secondary contact surfaces are formed on roller-like projection extending axially from the primary wheels.

44. The wheel set of claim 40 comprising at least four primary wheels in substantial alignment, wherein a secondary contact surface is disposed on each side of two adjacent primary wheels.

45. An in-line skate of claim 25, wherein the primary axle and the secondary axle are the same.

46. A wheel set for an in-line skate of claim 35, wherein the primary axle and the secondary axle are the same.

47. An in-line skate of claim 25, wherein the primary axle and the secondary axle are independent.

48. A wheel set for an in-line skate of claim 35, wherein the primary axle and the secondary axle are independent.

* * * * *